United States Patent [19]

Polk et al.

[11] Patent Number: 4,638,505

[45] Date of Patent: Jan. 20, 1987

[54] OPTIMIZED LOW FREQUENCY RESPONSE OF LOUDSPEAKER SYSTEMS HAVING MAIN AND SUB-SPEAKERS

[75] Inventors: Matthew S. Polk; Colin B. Campbell, both of Baltimore, Md.

[73] Assignee: Polk Audio Inc., Baltimore, Md.

[21] Appl. No.: 769,345

[22] Filed: Aug. 26, 1985

[51] Int. Cl.[4] ..... H04R 5/00

[52] U.S. Cl. ..... 381/24; 381/99; 381/89

[58] Field of Search ..... 381/1, 24, 99, 100, 381/89, 101, 103

[56] References Cited

U.S. PATENT DOCUMENTS

| | | | |
|---|---|---|---|
| 3,657,480 | 4/1972 | Cheng et al. | 381/99 |
| 4,315,102 | 2/1982 | Eberbach | 381/99 |
| 4,489,432 | 12/1984 | Polk | 381/24 |
| 4,497,064 | 1/1985 | Polk | 381/24 |
| 4,569,074 | 2/1986 | Polk | 381/24 |
| 4,593,405 | 6/1986 | Frye et al. | 381/99 |
| 4,597,100 | 6/1986 | Grodinsky et al. | 381/99 |

*Primary Examiner*—Forester W. Isen

*Attorney, Agent, or Firm*—Cushman, Darby & Cushman

[57] ABSTRACT

A loudspeaker system for use with a stereo system having right R and left L signal outputs, has a right main speaker and right sub-speaker, and a left main speaker and left sub-speaker. Inter-speaker cabling means, which connect to the R and L signal outputs, apply an R signal to the right main speaker and an R-L signal to the right sub-speaker, as well as an L signal to the left main speaker and an L-R signal to the left sub-speaker. The inter-speaker cabling means includes impedances for substantially attenuating the −R portion of the L-R signal and the −L portion of the R-L signal for signal frequencies below approximately 200 Hz.

5 Claims, 2 Drawing Figures

OPTIMIZED LOW FREQUENCY RESPONSE OF LOUDSPEAKER SYSTEMS HAVING MAIN AND SUB-SPEAKERS

BACKGROUND OF THE INVENTION

The present invention relates to an improvement on the apparatus described in U.S. Pat. No. 4,489,432 wherein a method is described for reproducing sound and obtaining a realistic ambient field. One aspect of the method and apparatus described in U.S. Pat. No. 4,489,432, the disclosure of which is hereby incorporated by reference, is the requirement that a left minus right signal be developed and fed to the left sub-speaker and that a right minus left signal be developed and fed to the right sub-speaker. The application of these signals to the sub-speakers in combination with the other aspects of the invention produce an expanded acoustic image and realistic ambient field. However, in one preferred embodiment, the main speaker and sub-speaker on each side are housed within the same acoustic volume. An analysis of the performance of this system reveals the following possible combinations of signals being produced by the main and sub-speaker within the same acoustic volume:

| | Left Main Spkr | Left Sub-Spkr | Right Main Spkr | Right Sub-Spkr |
|---|---|---|---|---|
| Left & Right same | Left | Nil | Right | Nil |
| Left Only | Left | left | Nil | Minus Left |
| Right Only | Nil | Minus Rt | Right | Right |

From this table it can be seen that although the Main and Sub-speakers occupying the same acoustic volume never work against each other, they are not necessarily working together. It is well known that at midrange frequencies the loading presented by an acoustic volume does not significantly influence the response of the loudspeaker. However, at low frequencies, the response of the loudspeaker is controlled to a great extent by the ratio of total diaphragm area to acoustic volume. Obviously if, as shown in the table above, sometimes one and sometimes two speakers occupying the same acoustic volume may be operating, the ratio of total diaphragm area to acoustic volume will change accordingly by a factor of two depending on the relationship of the right and left channel signals. Under such circumstances it is impossible to tune the system for optimum low frequency response.

SUMMARY OF THE INVENTION

The object of the present invention is to derive the required signals for the sub-speakers in such a way that they will work in concert with the main speaker sharing the same acoustic volume at low frequencies regardless of the relationship of right to left channel stereo signals coming from the amplifier. A further object is to accomplish this without diminishing the performance of the system described in U.S. Pat. No. 4,489,432. An additional object is to develop the L-R, R-L signals in such a way as to present a more stable electrical load to the driving amplifier.

Briefly, in accordance with one embodiment of the invention, a speaker system is provided for connection in a stereo system having right channel plus and minus outputs and left channel plus and minus outputs. The speaker system includes a left main speaker and left sub-speaker, as well as a right main speaker and right sub-speaker. The system is such that a plus right signal (R) is applied to the right main speaker and a plus right minus left (R-L) is applied to the left sub-speaker. A plus left signal (L) is applied to the left main speaker and a plus left minus right signal (L-R) applied to the left sub-speaker. Each of the main and sub-speakers has plus and minus input terminals. In accordance with the present invention, inter-speaker cabling is used for developing the R-L and L-R signals for application to the sub-speakers. The inter-speaker cabling includes impedance means such that above approximately 200 Hz the right and left sub-speakers primarily receive, respectively, the R-L and L-R signals and below approximately 200 Hz the right and left sub-speakers primarily receive, respectively, the R and L signals.

DESCRIPTION OF THE PREFERRED EMBODIMENT

Figure 1:
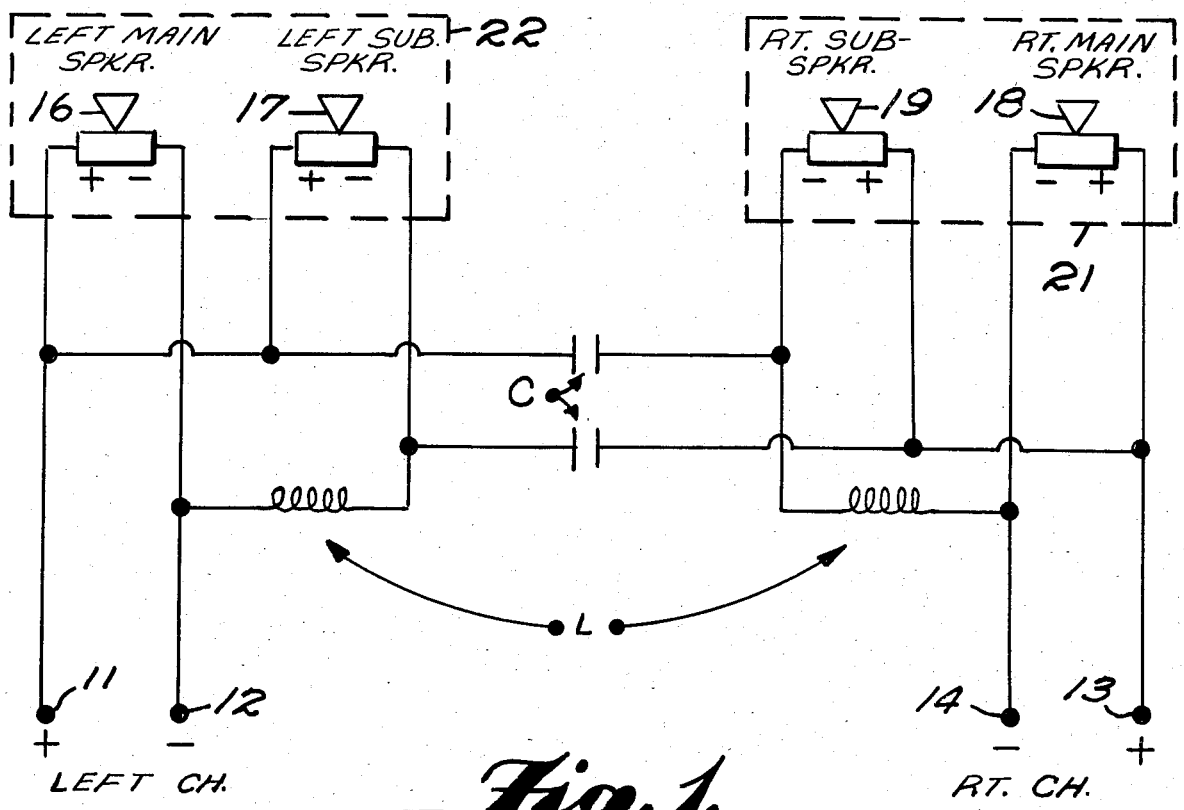
FIG. 1 is a schematic diagram showing inter-speaker connections which include impedance means in accordance with the invention.

FIG. 1 illustrates one embodiment of the present invention. In FIG. 1 there are schematically represented output terminals of a power amplifier in a stereo system, these being shown as left channel plus and minus terminals 11 and 12, and right channel plus and minus terminals 13 and 14. As shown in FIG. 1, the system of the present invention and as in accordance with U.S. Pat. No. 4,489,432 includes a left main speaker 16, a left sub-speaker 17, and corresponding right main speaker 18 and right sub-speaker 19. As shown in FIG. 1, each of the main speakers and sub-speakers has plus and minus input connections for coupling audio signals thereto. As discussed in U.S. Pat. No. 4,489,432, in accordance with one embodiment, the right main speaker and right sub-speaker may be commonly mounted in an enclosure, indicated by reference numeral 21. Similarly, the left main speaker and left sub-speaker may be commonly mounted in an enclosure 22.

Prior to the present invention, and as disclosed in U.S. Pat. No. 4,489,432, the L-R and R-L signals are developed by directing the voltage developed across the right plus amplifier terminal and the left plus amplifier terminal to the sub-speakers. When left plus is connected to the sub-speaker plus input terminal and Right plus is connected to the sub-speaker minus input terminal a L-R signal is produced by the sub-speaker. Reversing the connections to the sub-speaker input terminals will cause the sub-speaker to produce a R-L signal.

Experiments have determined that only the frequency range between about 200 Hz and 1,000 Hz is used by a listener's directional hearing mechanism to determine the direction of a sound on the basis of interaural time delays. Therefore if the L-R and R-L signals driving the sub-speakers are limited to above 200 Hz it will in no way affect the performance of the apparatus of U.S. Pat. No. 4,489,432. This may be accomplished, as shown in FIG. 1, simply by inserting a capacitor, C, of suitable value between the Left sub-speaker minus input terminal and the Right channel plus amplifier terminal 13, and, conversely, an identical capacitor between the Right sub-speaker minus input terminal and the Left channel plus amplifier terminal 11. Then, an inductor, L, may be used to connect each of the sub-speaker minus input terminals to the negative amplifier terminal of the channel on the same side as the sub-speaker in question. The values of the capacitor and inductor must be chosen such that for frequencies above approximately 200 Hz current flows primarily through the sub-speakers and between the Left and Right amplifier plus terminals. For frequencies below 200 Hz the current flow is primarily from the Left plus amplifier terminal through the Left sub-speaker to the Left minus amplifier terminal and from the Right plus amplifier terminal through the Right sub-speaker to the Right minus amplifier terminal. This means that each sub-speaker will receive a difference signal predominately above approximately 200 Hz and predominately a Left or Right channel signal only, as appropriate, below 200 Hz.

In one preferred embodiment of the present invention the sub-speakers have a nominal impedance of 4 ohms, the capacitor value is 260 uf and the inductor value is 16 mH. Experiments have shown that the choice of value for the capacitor is relatively critical and should be chosen such that its impedance at 200 Hz is similar to the nominal impedance of the sub-speakers. However, the value of inductance is relatively non-critical with the principle requirement that the impedance of the inductor at 200 Hz be at least twice the nominal impedance of one sub-speaker.

Figure 2:
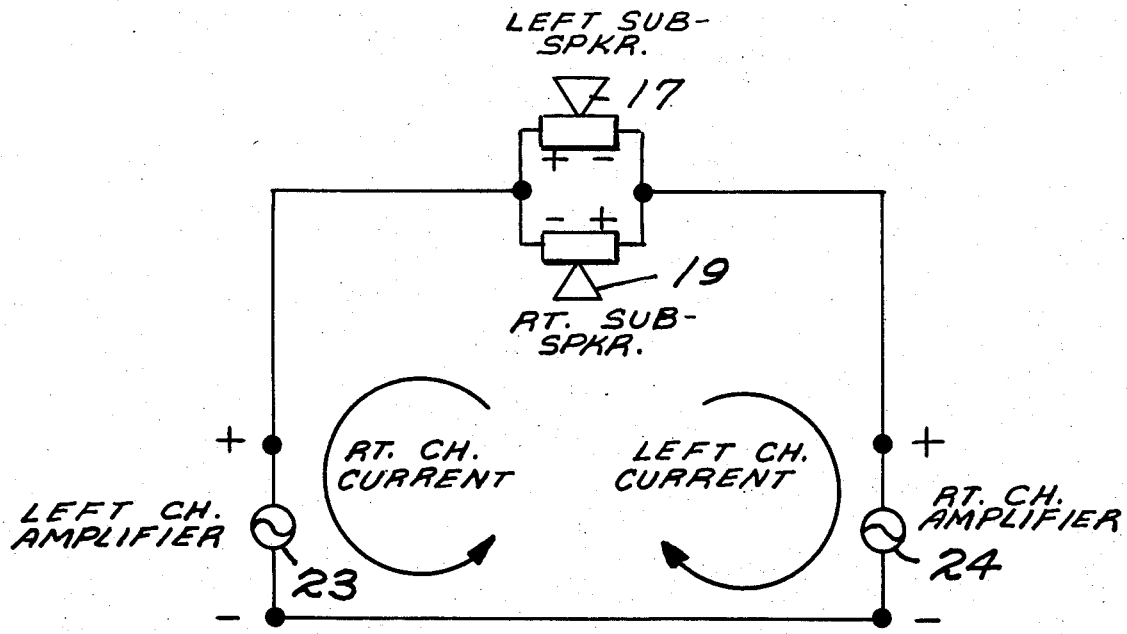
FIG. 2 is a schematic diagram illustrating current loops that arise when a difference signal is developed.

By allowing the sub-speakers to operate in a consistent manner at low frequencies regardless of the relationship of left and right stereo signals the system may be optimally tuned without the need for compromise necessitated by an indeterminate relationship between operation of the main and sub-speakers in the same acoustic volume. In addition, typical loudspeakers are most reactive at low frequencies and present loads to the amplifier causing significant phase shifts between voltage and current. As can be seen in FIG. 2, when a difference signal is derived between the two plus output terminals of an amplifier (left channel 23 and right channel 24), there are, in reality, two current loops each including the output of one amplifier channel flowing through the two sub-speakers 17 and 19 and the output section of the other amplifier channel. It can be shown that due to the nature of ordinary feed-back circuitry incorporated in most hi-fidelity amplifiers and the reactive nature of most loudspeakers at low frequencies, particularly below 100 Hz, the signal produced by each channel at these frequencies may be significantly altered by the presence of a substantial current flow from the other channel passing through the sub-speakers. The result may be a considerable reduction in the quality of low frequency performance. Experiments have shown this to be true and that other frequency ranges may be affected as well. Above 200 Hz it is not difficult to achieve a loudspeaker design whose impedance is mainly resistive in nature. In addition, current flows are typically much less above 200 Hz than those encountered below 200 Hz. This indicates that the effect described above will not be significant above approximately 200 Hz. Experiments have confirmed that for resistive loads no significant alteration of the signal occurs due to a current flowing from the other amplifier channel. Finally, as discussed above, the elimination of the minus Right or minus Left signals from the sub-speakers below 200 Hz has no effect on the ability of the system to reproduce an expanded acoustic image except to the extent that overall performance is improved due to the elimination of the problems discussed above.

While the present invention has been described with reference to a specific preferred embodiment, it should be clearly understood that various modifications and changes thereto are within the skill of one working in this art, without departing from the true spirit and scope of the invention.

We claim:

1. A loudspeaker system for a stereophonic sound reproduction system having a right channel output signal R with plus and minus output terminals and a left channel output signal L with plus and minus output terminals, said loudspeaker system comprising a right main speaker and a right sub-speaker, a left main speaker and a left sub-speaker, each of said main speakers and sub-speakers having plus and minus input terminals, interspeaker cabling means for applying signal R to said right main speaker, and a signal R-L to said right sub-speaker, and a signal L to said left main speaker and a signal L-R to said left sub-speaker, said interspeaker cabling means including impedance means having values selected to substantially attenuate the −L portion of the R-L applied to the right sub-speaker signal and the −R portion of the L-R signal applied to the left sub-speaker for signal frequencies of below approximately 200 Hz.

2. A loudspeaker system in accordance with claim 1 including a left enclosure commonly mounting said left main speaker and left sub-speaker and a right enclosure commonly mounting said right main speaker and right sub-speaker, and wherein said interspeaker cabling means includes conductors for connecting the right channel plus and minus output terminals respectively to said plus and minus input terminals of said right main speaker and the left channel plus and minus output terminals respectively to the plus and minus input terminals of said left main speaker.

3. A loudspeaker system in accordance with claim 1 wherein said impedance means includes a first capacitor coupling the plus terminals of said left main speaker and left sub-speaker to the minus terminal of said right sub-speaker and a second capacitor coupling the plus terminals of said left main speaker and left sub-speaker to the minus terminal of said right sub-speaker, the values of said first and second capacitors being selected such that their respective impedances for signals of approximately 200 Hz is approximately equal to the nominal impedance of a sub-speaker.

4. A loudspeaker system in accordance with claim 3 wherein said impedance means also includes a first inductor coupling the minus terminal of said left main speaker to the minus terminal of said left sub-speaker and a second inductor coupling the minus terminal of said right main speaker to the minus terminal of said right sub-speaker.

5. A loudspeaker system in accordance with claim 4 wherein each of said first and second inductors has a value such that the impedance thereof for signals of approximately 200 Hz is at least twice the nominal impedance of a sub-speaker.

* * * * *